US008650841B2

(12) United States Patent
Knoblauch

(10) Patent No.: US 8,650,841 B2
(45) Date of Patent: Feb. 18, 2014

(54) PACKING COMPRESSIBLE OBJECTS

(75) Inventor: Jan Waltersdorph Knoblauch, Ribe (DK)

(73) Assignee: Seelen A/S, Esbjerg (DK)

( * ) Notice: Subject to any disclaimer, the term of this patent is extended or adjusted under 35 U.S.C. 154(b) by 487 days.

(21) Appl. No.: 12/777,512

(22) Filed: May 11, 2010

(65) Prior Publication Data

US 2010/0293894 A1 Nov. 25, 2010

(30) Foreign Application Priority Data

May 22, 2009 (EP) ..... 09006900

(51) Int. Cl.

| | |
|---|---|
| ***B65B 63/02*** | (2006.01) |
| ***B65B 11/18*** | (2006.01) |
| ***B65B 11/54*** | (2006.01) |
| ***B65B 9/02*** | (2006.01) |

(52) U.S. Cl.

USPC ..... 53/436; 53/466; 53/528; 53/228; 53/230

(58) Field of Classification Search

CPC ..... B65B 9/026; B65B 11/06; B65B 11/08; B65B 11/12; B65B 11/18; B65B 11/22; B65B 11/54; B65B 63/02

USPC ..... 53/436, 438, 466, 528, 529, 228, 230, 53/232, 372.4, 372.5, 375.4, 376.2

IPC ..... B65B 63/02, 11/54, 11/06, 11/08, 11/12, B65B 11/18, 11/22

See application file for complete search history.

(56) References Cited

U.S. PATENT DOCUMENTS

| | | | | | |
|---|---|---|---|---|---|
| 1,055,049 | A | * | 3/1913 | Keyes | 53/230 |
| 1,468,626 | A | * | 9/1923 | Brownell | 53/230 |
| 1,816,085 | A | * | 7/1931 | Langhammer | 53/466 |
| 2,765,602 | A | * | 10/1956 | Hibbard et al. | 53/230 |
| 3,006,119 | A | * | 10/1961 | Fingerhut | 53/438 |
| 3,577,865 | A | * | 5/1971 | Hain et al. | 53/436 |
| 3,600,875 | A | * | 8/1971 | Buob et al. | 53/230 |
| 3,648,431 | A | * | 3/1972 | Hartbauer et al. | 53/528 |
| 3,861,120 | A | * | 1/1975 | Gordon | 53/230 |
| 4,078,363 | A | * | 3/1978 | Ranzi | 53/228 |
| 4,085,564 | A | * | 4/1978 | Focke | 53/228 |
| 5,406,774 | A | | 4/1995 | Dodge | |

FOREIGN PATENT DOCUMENTS

| | | | | | |
|---|---|---|---|---|---|
| DE | 2824381 | A1 | | 12/1979 | |
| DE | 10111829 | A1 | | 10/2002 | |
| EP | 0679579 | A1 | | 11/1995 | |
| GB | 2151577 | A | * | 7/1985 | 53/230 |

OTHER PUBLICATIONS

European Search Report and Annex to the European Search Report. EP099006900. European Patent Office. Date of completion of the search: Oct. 5, 2009, 4 pages.

* cited by examiner

*Primary Examiner* — Stephen F Gerrity

(74) *Attorney, Agent, or Firm* — Mollborn Patents, Inc.; Fredrik Mollborn

(57) ABSTRACT

The invention relates to a low friction gliding plate designed to optimize the process of packing at least one compressible object, such as insulation material, in continuous foil. In addition the present invention relates to a method for using a low friction gliding plate in packaging at least one compressible object.

6 Claims, 4 Drawing Sheets

PACKING COMPRESSIBLE OBJECTS

BACKGROUND

The invention relates to a low friction gliding plate designed to optimize the process of packing one or more compressible objects, such as insulation material. A conventional machine for packing one or more compressible objects into one larger packet usually uses a technique where the object(s) are gathered, compressed and subsequently directed into the wrapping foil forming one stack. In this way the wrapping foil is fitted tightly around the three sides of the packet. At the fourth end, the object(s) are being held in a compressed state by a set of spears. The wrapping foil is wrapped around the spears and sealed e.g. by welding where after the spears are removed. The latter will cause the compressed object(s) to expand so as to fill out the empty space left by the spears.

In the industry of insulation material it is of outmost importance that the cubic content of the packets is reduced to a minimum, enabling transportation of an increased number of packets per volume. By using the spears described, the volume of the packets is greater than desired, but can be compensated for by over-compressing the compressible objects. Hence, when the spears are removed, the compressed object (s) will expand into the space made by the over-compression. However, by using over-compression there is a risk that the material properties of the objects are damaged.

An additional problem with using spears is the friction forces existing between both the spears and the wrapping foil and the spears and the compressed objects. When the spears are removed both the wrapping foil and the compressed object(s) can be damaged due to the friction forces.

Further, it is quite common for the wrapping foil to have some kind of text or illustration printed onto it. Part of this print can be transferred to the spears when the spears and the wrapping foil slide against one another thereby inducing friction between the spears and the wrapping foil. If the individual objects have been pre-packed in a printed foil, part of this print will also be transferred to the spears, inducing additional friction again. Over time, there will thus be a continuous increase of friction between the spears and the foil and/or the objects. The problem with friction induced damages on foil and/or the compressed object(s) will merely grow as the print from the foil is transferred and accumulated on the spears. The only way to solve this problem is to clean the spears on a regular basis. However, this is time consuming and increases the down time of the packaging machine.

The conventional wrapping machine therefore leaves the problem of either damaging the product due to over-compression or wasting wrapping foil due to rewinding of the foil. In addition, there is the problem of friction induced damage to the product/wrapping foil. A device is needed, which would have minimum friction force towards the foil and/or the compressible object(s) and render over-compression of the compressible object(s) and rewinding of the wrapping foil superfluous.

SUMMARY

Embodiments of the present invention relate to methods, apparatus and systems for wrapping at least one compressible object in continuous foil. In one embodiment, the system comprises:

wrapping means for wrapping at least a first side of said at least one compressible object whereby said continuous foil covers said first side and extends in a first direction parallel to said first side, a low friction gliding plate, wrapping means for wrapping at least a second side of said at least one compressible object by pushing said at least one compressible object towards said continuous foil and a low friction gliding plate whereby said second side of said at least one compressible object and said continuous foil are moved in a second direction parallel to said low friction gliding plate.

It is thereby possible to wrap the compressible object without having to perform an over compression in order to make space for a spear resulting in decompression when the spear is removed. This makes it possible to make smaller packages—which is a huge advantage both when it comes to transport storage and handling.

In an embodiment the low friction gliding plate is air lubricated. This is an especially advantageous way of obtaining a low fricton.

In another embodiment the surface material of said low friction gliding plate has a low friction. Such special surface material could be obtained by performing specific surface treatments such as coating or polishing.

In another embodiment said apparatus further comprises at least one compression plate for compressing said at least one compressible object prior to wrapping at least a first side of said at least one compressible object. The compression plate could be air lubricated. Thereby the sliding surface and the compression plate are incorporated in the same unit.

The invention further relates to methods of wrapping at least one compressible object in continuous foil, wherein in one embodiment a method comprises the steps of:

wrapping at least a first side of said at least one compressible object whereby said continuous foil covers said first side and extends in a first direction parallel to said first side, wrapping at least a second side of said at least one compressible object by pushing said at least one compressible object towards said continuous foil and a low friction gliding plate whereby said second side of said at least one compressible object and said continuous foil are moved in a second direction parallel to said low friction gliding plate.

DETAILED DESCRIPTION

Figure 1A:
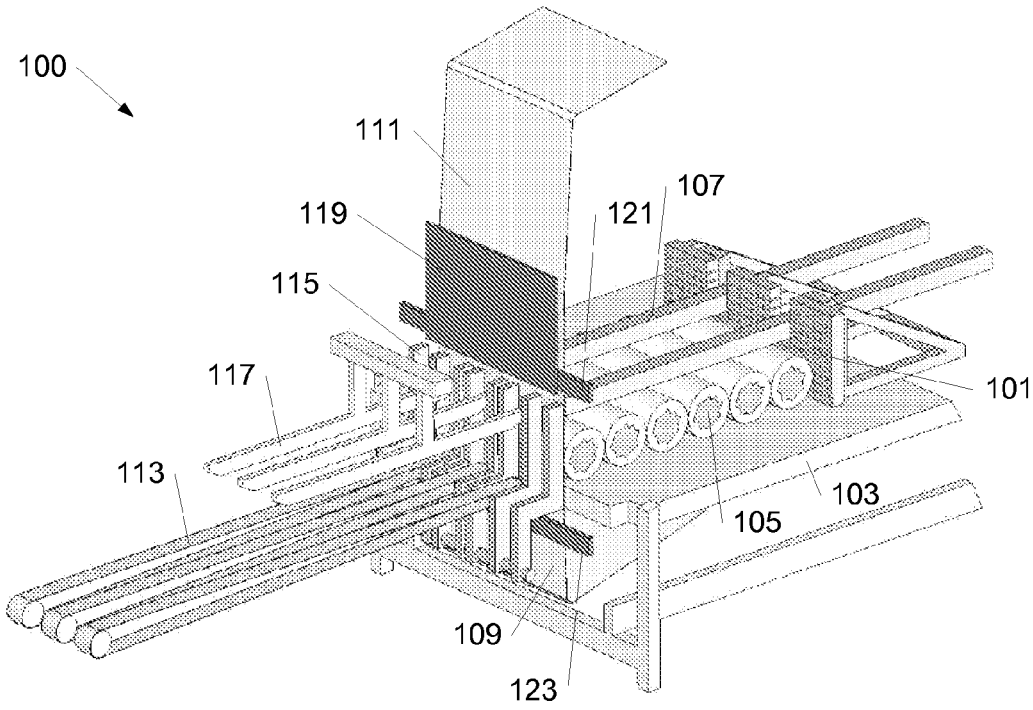
FIGS. 1*a-b* illustrate a packing machine with a low friction gliding plate, in accordance with an embodiment of the invention.
Figure 1B:
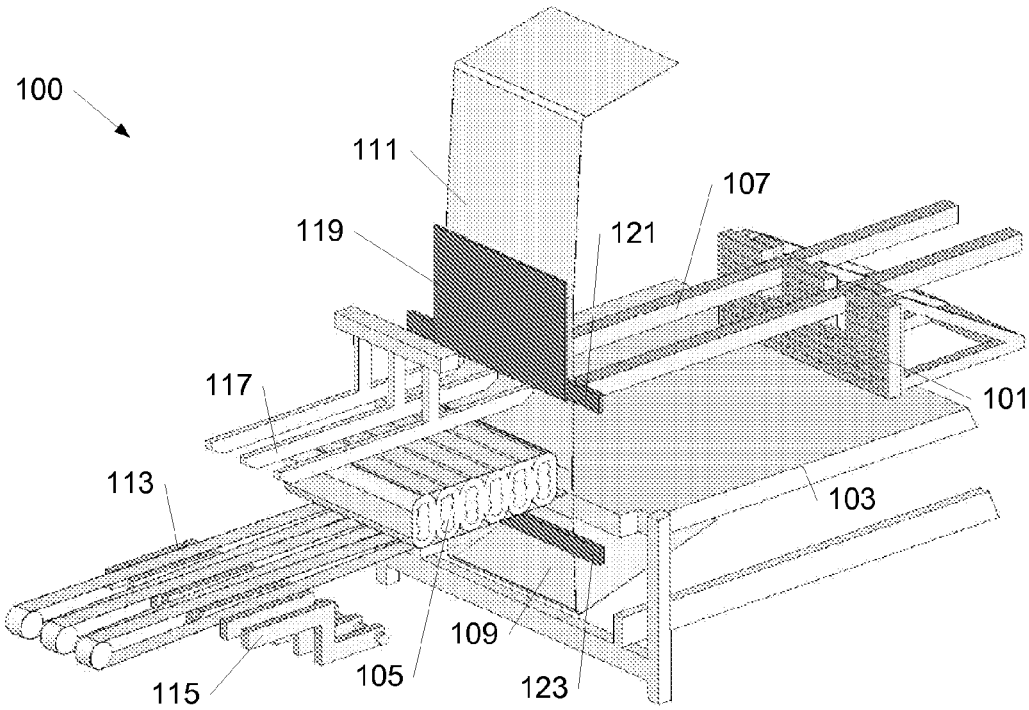

FIGS. 1*a* and 1*b* illustrate a packing machine 100 according to the present invention comprising a compression plate 101, a surface table 103 on which one or more compressible objects 105 can be placed and a first top guide 107, which insures that the compressible object(s) 105 are held on the surface table 103 during compression. FIG. 1*a* illustrates the packing machine 100 prior to wrapping the compressible object(s) 105, whereas FIG. 1*b* illustrates the wrapping machine 100 post wrapping the compressible object(s) 105. The compression plate 101, the surface table 103 and the first top guide 107 may be air-lubricated.

The packing machine further comprises a lower roll of wrapping foil 109 extending below the surface table 103, an upper roll of wrapping foil 111 extending above the first top guide 107. The wrapping foils 109, 111 are kept tight by the tightening devices (not shown in the figure) ensuring that the foil 109, 111 is kept stretched for tight wrapping of the compressed object(s) 105.

The wrapping foil 109, 111 can be of an elastic material, which may be stretchable in at least one direction.

The packing machine can be embodied with two rolls of wrapping foils. In another embodiment of the invention, only one roll of wrapping foil is utilized to wrap the compressible object(s) 105.

The packing machine additionally comprises a transport surface 113 onto which the compressed object(s) 105 are transferred during the wrapping process. The machine further comprises a backstop 115 against which the compressible objects 105 are compressed. The compressed objects are held in place between the transport surface 113 and a second top guide 117. The purpose of the second top guide 117 resembles the one of the first top guide 107. Both top guides 107, 117 can be adjusted in a vertical direction to accommodate different sizes of compressible object(s) 105. The vertical movement of the second top guide 117 is also used in wrapping the foil around the compressible object(s) 105, which will be described later. The transport surface 113, the stop arm 115 and the second top arm 117 may be air-lubricated.

The packing machine in FIG. 1 further comprises a low friction gliding plate 119, an upper welding bar 121 preferably situated between the low friction gliding plate 119 and the upper roll of wrapping foil 111, and a lower welding bar 123 preferably situated such that vertically, the lower roll of wrapping foil 109 is on the same side of the lower welding bar 123, as the upper roll of wrapping foil 111 is in relation to the upper welding bar 121. The low friction of the gliding plate 119 is obtained by air-lubricating the plate.

In one embodiment of the invention, the upper welding bar 121 is mounted directly on the low friction gliding plate 119. In another embodiment of the invention, the upper welding bar 121 is not attached to the low friction gliding plate 119 and the two objects can move independently of one another.

Figure 2A:
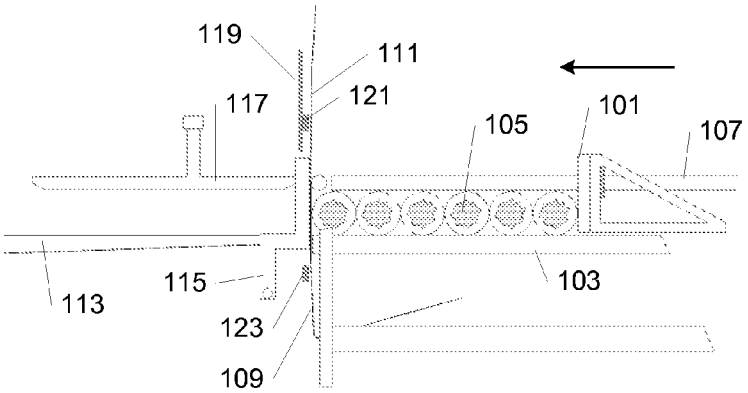
FIGS. 2*a-f* illustrate different steps in the wrapping process using the low friction gliding plate, in accordance with an embodiment of the invention.

FIGS. 2*a-f* illustrate the different steps in the wrapping procedure in a side view perspective. FIG. 2*a* shows the position of the compressible object(s) 105 before the wrapping process is initiated. Hereafter the compressible object(s) 105 are compressed by moving the compression plate 101 towards the backstop 115 positioned just behind the foil 109, 111. The top guide 107 and the surface table 103 ensure that the compressible object(s) 105 do not leave the packing machine 100 during compression.

Figure 2B:
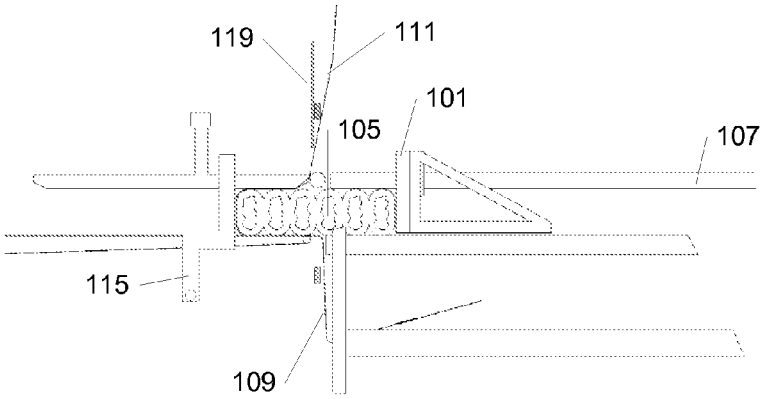
Figure 2C:
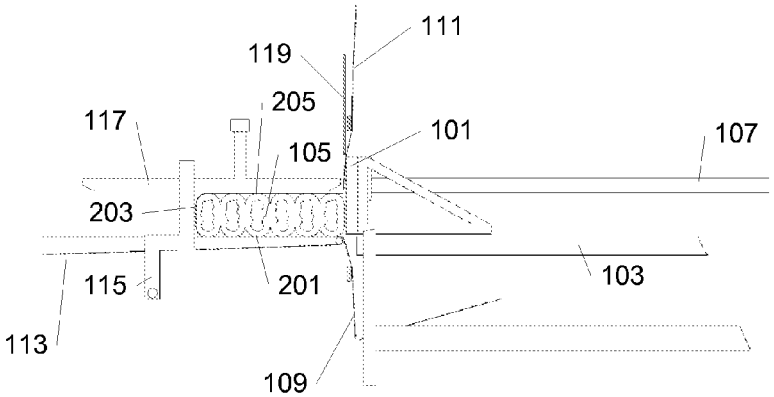

In FIG. 2*b*, the now compressed compressible object(s) 105 are led into and wrapped in the foil 109, 111. The compressed state of the compressible object(s) 105 is maintained by keeping them compressed between the backstop 115 and the compression plate 101. Leading the compressible object (s) 105 into the foil 109, 111 is enabled by a coordinated movement of the compression plate 101 and the backstop 115. Hereby the compressible objects are moved from the surface table 103 to the transport surface 113 and the wrapping foil 109, 111 is wrapped around the three sides 201, 203 and 205 of the compressed object(s) 105. The top guides 107, 117 ensure that the compressed object(s) stay on the surface table 103 and the transport surface 113, respectively. This movement of the compressible object(s) 105 stops when the compression plate 101 aligns approximately with the gliding plate 119 (see FIG. 2*c*).

Figure 2D:
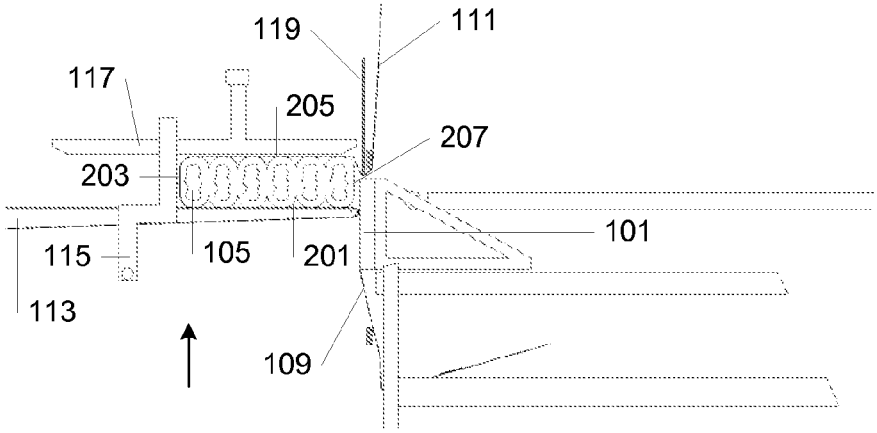

FIG. 2*d* illustrates the next step in the wrapping process, where the wrapping foil 109, 111 is wrapped along the fourth side 207. The wrapping foil 109, 111 is wrapped around the fourth side 207 of the compressed object(s) 105 by moving the transport surface 113, the backstop 115 and the second top guide 117 upwards. During this movement the fourth and unwrapped end 207 of the compressed object(s) 105 is moved from the compression plate 101 and up and along the low friction gliding plate 119. This means that the compression force exerted by the compression plate 101 is transferred to and maintained by the low friction gliding plate 119. In this process, the upper roll of wrapping foil 111 is located between the low friction gliding plate 119 and the fourth end 207 of the compressed object(s) 105.

Figure 2E:
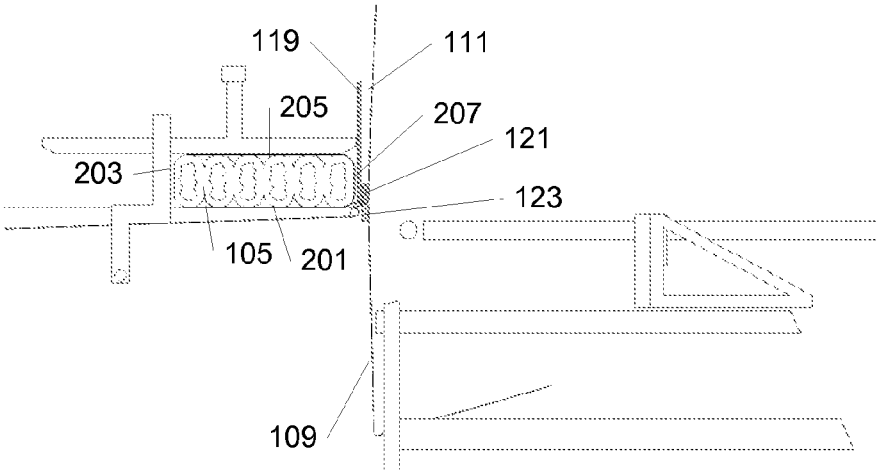
Figure 2F:
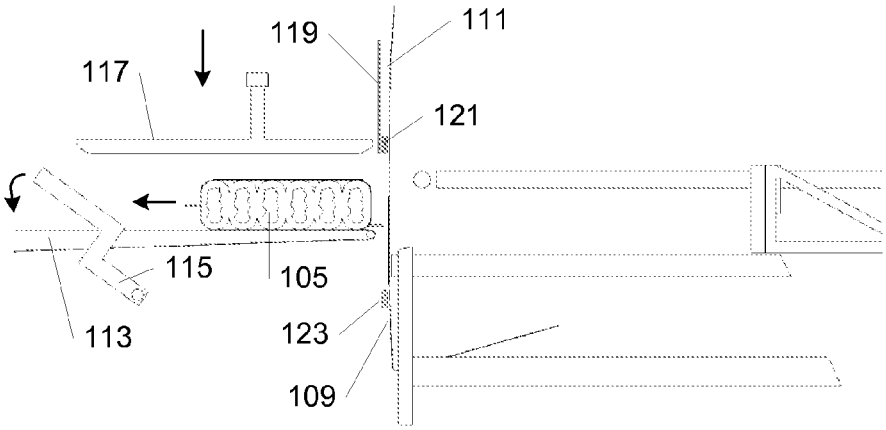

As illustrated in FIG. 2*e*, the two foils 109, 111 subsequently meet at the bottom of the compressed object(s) 105, i.e. at the corner where the sides 201 and 207 meet. Hereafter the two welding bars 121, 123 are moved together with the wrapping foil 109, 111 lying in between the welding bars 121, 123. The two knifes 121, 123 melt the foil together and subsequently cut the foil in two, whereby the compressed object(s) 105 are packed.

After completing the wrapping of the compressible object (s) 105, the transport surface 113 with the wrapped compressed object(s) 105, and the second top plate 117 are moved downwards returning to their first position as shown in FIG. 2*a*. The melting knives 121, 123 likewise return to their first position. By turning the backstop 115 to a horizontal position, the wrapped compressed object(s) 105 are moved along the transport surface 113 in a direction away from the surface table 103.

Figure 3:
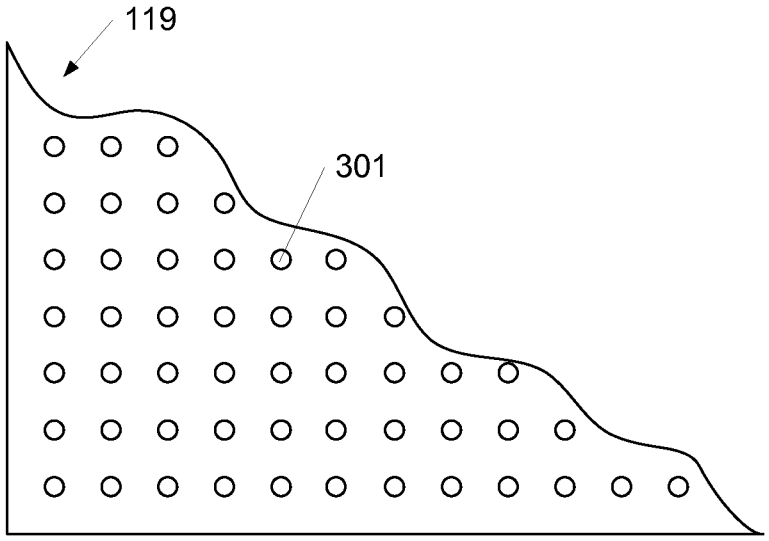
FIG. 3 illustrates an embodiment of the low friction gliding plate, in accordance with an embodiment of the invention.

FIG. 3 illustrates one embodiment of the low friction gliding plate 119 seen in detail in a front view. The low friction gliding plate 119 is air-lubricated by means of a number of openings, nozzles, or jets 301 positioned on the plate. The shape, the number and the distance between the openings 301 may be as illustrated in the figure with circular openings equally laid out horizontally and vertically, but could equally well vary both in shape, number and the way they are laid out both horizontally and vertically. For instance, instead of circular openings, rectangular openings may be used. The low friction properties of the low friction gliding plate 119 could also be obtained by having a surface with a low roughness, which will increase its gliding properties. Such a low roughness surface can optionally be combined with the described air-lubrication.

REFERENCES

100: Wrapping machine
101: Compression plate
103: Surface table
105: One or more compressible objects
107: First top guide
109: First roll of wrapping foil
111: Second roll of wrapping foil
113: Transport surface
115: Backstop
117: Second top guide
119: Low friction gliding plate
121: Upper welding bar
123: Lower welding bar
201: Bottom side of the packet of compressed object(s)
203: Rear end side of the packet of compressed object(s)

205: Top side of the packet of compressed object(s)
207: Front end side of the packet of compressed object(s)
301: Openings, nozzles or jets

The invention claimed is:

1. An apparatus for wrapping at least one compressible object (105) in continuous foil (109, 111), the apparatus comprising:

wrapping means for wrapping at least a first side of said at least one compressible object (105) leaving one side unwrapped (207) whereby said continuous foil (109, 111) covers all sides (201, 203, 205) of said at least one compressible object, except said one unwrapped side;

a low friction gliding plate (119);

a compression plate (101) for exerting a compression force on said at least one compressible object (105); and wrapping means for wrapping said unwrapped side of said at least one compressible object (105) by pushing said unwrapped side of said at least one compressible object (105) from the compression plate (101) towards said continuous foil (109, 111) and towards and along said low friction gliding plate (119) in a direction parallel to said low friction gliding plate (119) such that said compression force exerted on said at least one compressible object (105) is transferred to and maintained by said low friction gliding plate (119), whereby said low friction gliding plate maintains compression across said unwrapped side while wrapping said unwrapped side.

2. An apparatus for wrapping at least one compressible object (105) according to claim 1, wherein said low friction gliding plate (119) is air lubricated.

3. An apparatus for wrapping at least one compressible object (105) according to claim 1, wherein the surface material of said low friction gliding plate (119) has a low friction.

4. An apparatus for wrapping at least one compressible object (105) according to claim 1, wherein said apparatus further comprises at least one compression plate (101) for compressing said at least one compressible object (105) prior to wrapping at least a first side of said at least one compressible object (105).

5. An apparatus for wrapping at least one compressible object (105) according to claim 4, wherein said compression plate is air lubricated.

6. A method of wrapping at least one compressible object (105) in continuous foil (109, 111), wherein the method comprises the steps of:

wrapping at least a first side of said at least one compressible object (105) leaving one side unwrapped (207) whereby said continuous foil (109, 111) covers all sides (201, 203, 205) of said at least one compressible object, except said one unwrapped side; and wrapping said unwrapped side of said at least one compressible object (105) by pushing said unwrapped side of said at least one compressible object (105) from a compression plate (101) towards said continuous foil (109, 111) and towards and along a low friction gliding plate (119) in a direction parallel to said low friction gliding plate (119) such that a compression force exerted on said at least one compressible object (105) is transferred to and maintained by said low friction gliding plate (119)), whereby said low friction gliding plate maintains compression across said unwrapped side while wrapping said unwrapped side.

* * * * *